United States Patent [19]

Greeves et al.

[11] Patent Number: 4,936,755

[45] Date of Patent: Jun. 26, 1990

[54] FUEL INJECTION PUMPING APPARATUS

[75] Inventors: Godfrey Greeves, Hatch End; Kenneth M. Harris, Maidstone, both of England

[73] Assignee: Lucas Industries Public Limited Company, Birmingham, England

[21] Appl. No.: 297,248

[22] Filed: Jan. 13, 1989

[30] Foreign Application Priority Data

May 27, 1988 [GB] United Kingdom ..... 8812651

[51] Int. Cl.[5] ..... F02M 59/02

[52] U.S. Cl. ..... 417/307; 417/462

[58] Field of Search ..... 417/279, 283, 307, 462, 417/463, 486, 487, 488; 123/450, 506, 447

[56] References Cited

U.S. PATENT DOCUMENTS 3,161,138 12/1964 Koster ..... 417/462
4,462,368 7/1984 Funada ..... 123/447
4,622,942 11/1986 Nozaki et al. ..... 123/447

FOREIGN PATENT DOCUMENTS 2206382 1/1989 United Kingdom ..... 123/450

*Primary Examiner*—Leonard E. Smith
*Assistant Examiner*—Douglas J. Makosy
*Attorney, Agent, or Firm*—Balogh, Osann, Kramer, Dvorak, Genova & Traub

[57] ABSTRACT

A rotary distributor fuel pumping apparatus for supplying fuel to an internal combustion engine has a pair of pumping plungers housed in a diametrical bore formed in the distributor member. The plungers at a predetermined position during their inward movement open a spill path to terminate delivery of fuel through an outlet. The one plunger defines a plunger bore and the other plunger has an integral piston slidable therein. The piston has a relieved portion adjacent the other plunger which with the wall of the plunger bore forms a flow path from the pumping chamber the flow path communicating with a port at a predetermined position during the inward movement. The pumping chamber is of annular form and is defined between the plungers and the wall of the bore in the distributor member and the piston.

6 Claims, 3 Drawing Sheets

FUEL INJECTION PUMPING APPARATUS

Figure 1:
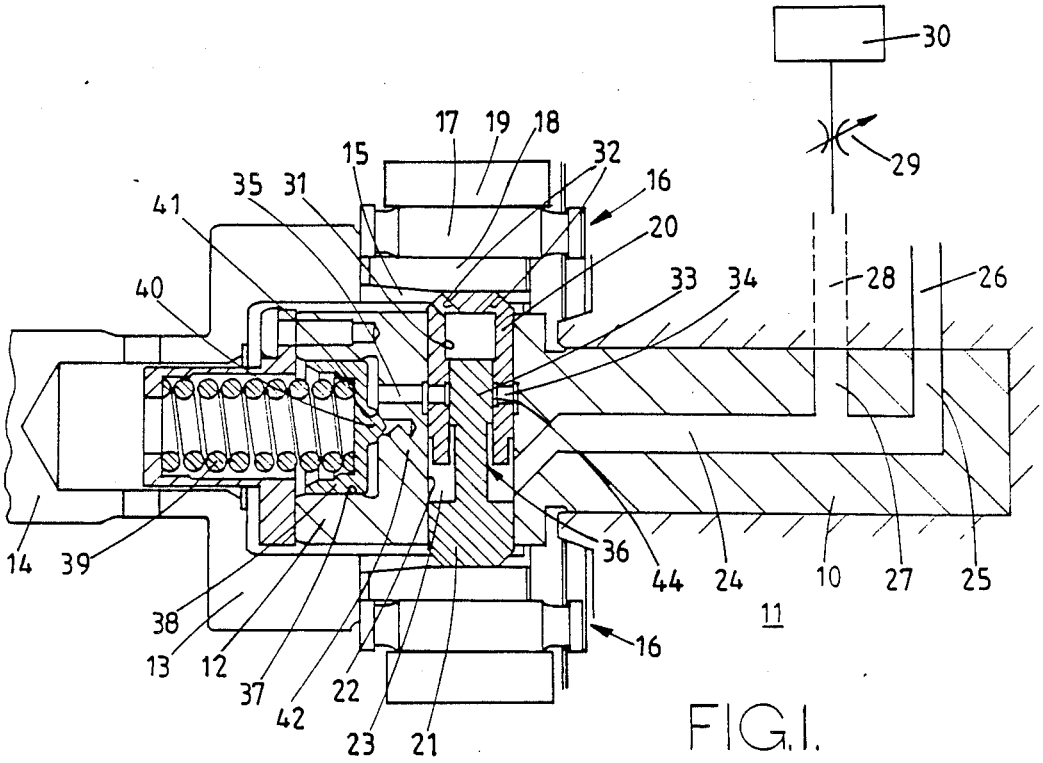

This invention relates to a fuel injection pumping apparatus for supplying fuel to an internal combustion engine, the apparatus being of the kind comprising a rotary distributor member mounted in a body part and adapted to be driven in timed relationship with an associated engine, a plunger bore in the distributor member, a pair of plungers slidable in the bore, cam means for imparting inward movement to the plungers, passage means for feeding fuel displaced by the plungers during their inward movement to a plurality of outlet ports in turn and for supplying fuel from a source of fuel under pressure to effect outward movement of the plungers and valve means defined by said plungers, said valve means being opened at a predetermined position during the inward movement of the plungers to terminate flow of fuel to an outlet.

An apparatus of the aforesaid kind is known from British Patent specification 990695 and in which one plunger is smaller in diameter than the other and is slidable in the manner of a piston, in a blind bore formed therein. The pumping chamber from which fuel is expelled during inward movement of the plungers is defined by the blind end of the bore and it communicates with a port in the wall of the one plunger and this port is in constant communication with a passage formed in the distributor member through which fuel flows to and from the pumping chamber. In addition, the one plunger is formed with a blind passage which communicates with the pumping chamber and the passage communicates with a first groove on the periphery of the one plunger. The first groove at a predetermined position during the inward movement of the plungers registers with a port in the wall of the other plunger and the port by way of a second groove in the periphery of the other plunger communicates with a spill passage in the distributor member.

For a given stroke and diameter of the bore in the distributor member it is apparent that the volume of fuel which can be displaced by the plungers will be considerably less than the displacement of a conventional pair of plungers. This is because the diameter of the blind bore in the other plunger is less than the diameter of the bore in the distributor member by twice the thickness of the wall of the other plunger. It is not possible to reduce the wall thickness to any appreciable extent and therefore in order to increase the volume of fuel which can be displaced by the plungers it is necessary to increase the diameter of the bore in the distributor member.

The object of the present invention is provide an apparatus of the aforesaid kind in an improved form.

According to the invention in an apparatus of the kind specified one of said plungers defines a plunger bore in which is slidable a piston integral with the other plunger. The inner ends of the plungers and the annular space defined about the piston and bounded by the bore in the distributor member defining a pumping chamber from which fuel is displaced to an outlet during inward movement of the plungers, port means formed in the wall of the plunger bore and through which fuel can escape from said pumping chamber and a reduced portion on said piston adjacent the plunger, said reduced portion defining with the wall of the plunger bore a flow path from said pumping chamber and which is opened to said port means at a predetermined relative position during the inward movement of the plungers.

Figure 2:
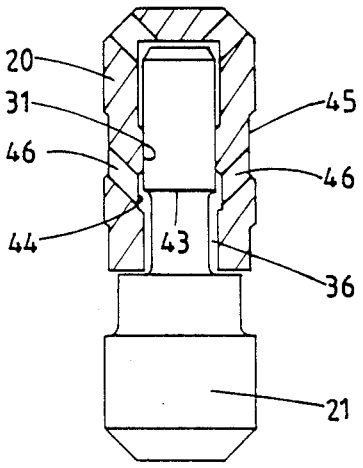
Figure 3:
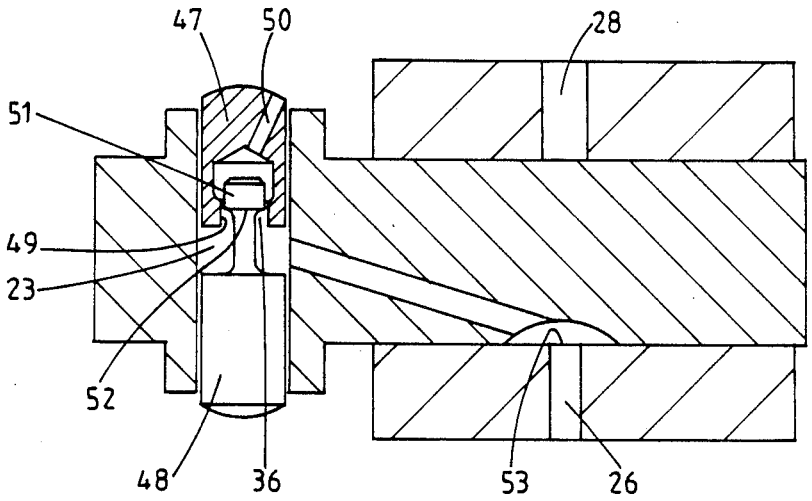
Figure 4:
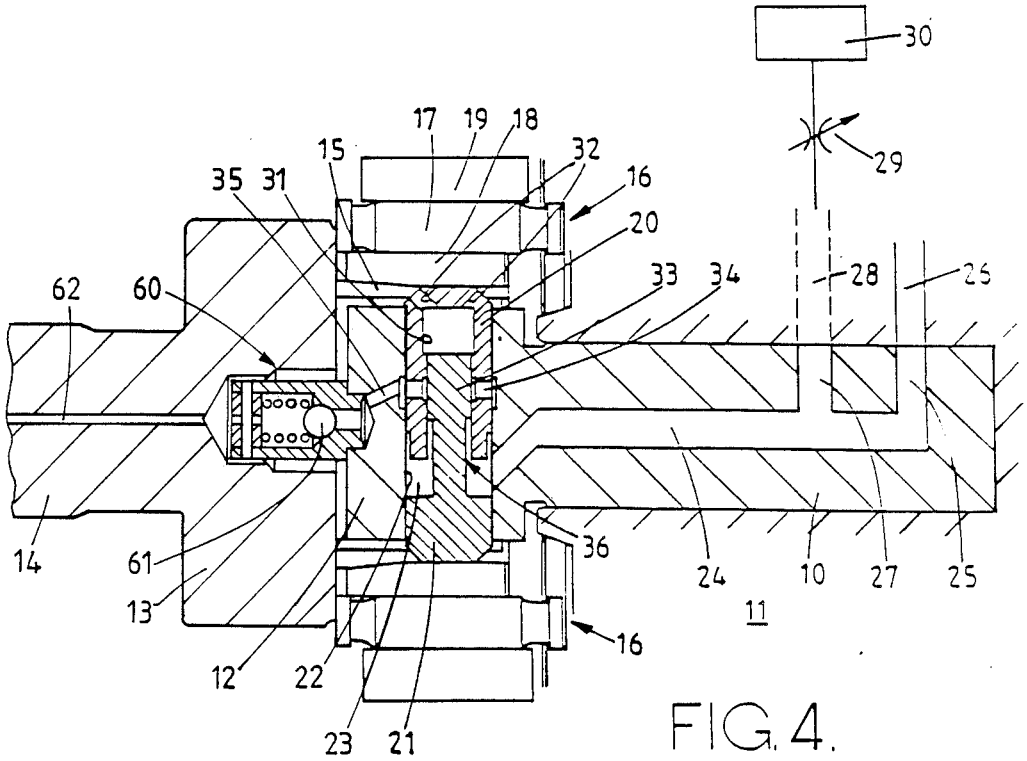

Examples of fuel pumping apparatus in accordance with the invention will now be described with reference to the accompanying drawings in which, FIG. 1 is a sectional side elevation showing part of one example of an apparatus in accordance with the invention, FIG. 2 is a view to an enlarged scale of a modified part of the apparatus seen in FIG. 1, FIG. 3 is a view similar to FIG. 1 showing another example of the apparatus, and FIG. 4 shows a modification of the apparatus of FIG. 1.

Referring to FIG. 1 of the drawings the pumping apparatus comprises a rotary distributor member 10 which is mounted within a body 11. The distributor member has an enlarged portion 12 surrounding which is a cup shaped drive member 13 which is mounted at the end of a rotary drive shaft 14 which in use is coupled to a rotary component of an associated engine. The distributor member is coupled to the cup shaped member so as to rotate therewith.

The cup shaped member 13 is provided with a pair of diametrically disposed slots 15 in which are located cam followers 16 each comprising a roller 17 and a shoe 18. The rollers engage the internal peripheral surface of an annular cam ring 19 which is provided with a plurality of pairs of diametrically disposed cam lobes (not shown). The shoes engage the outer ends of a pair of plungers 20, 21 respectively which are slidably mounted within a bore 22 formed in the distributor member.

The plungers define a pumping chamber 23 which is in constant communication with a passage 24 formed in the distributor member and connected to a delivery passage 25 which is positioned to register in turn with a plurality of outlets 26 formed in the body 11. The outlets in use are connected to the injection nozzles respectively of the associated engine. The passage 24 also communicates with an inlet passage 27 which can register in turn with a plurality of inlet ports 28 formed in the body 11 and connected through an adjustable throttle 29, with a source 30 of fuel under pressure. In use, when the plungers are moved inwardly fuel is expelled from the pumping chamber 23 and flows by way of the passage 24 and the delivery passage 25 to an outlet 26. During continued rotation of the distributor member the passage 25 moves out of register with an outlet 26 and the inlet passage 27 is brought into register with an inlet port 28. Fuel can now flow to the pumping chamber 23 to effect outward movement of the plungers and the amount of fuel which flows is determined by the adjustable throttle 29 which in practice will have associated with it, a speed governor mechanism. During continued rotation of the distributor member fuel is supplied to the outlets 26 in turn.

As described the fuel will flow through the outlet 26 until the rollers run over the crests of the cam lobes. This can create undesirable stresses in the material forming the cam lobes and also the rollers and therefore the apparatus is such that at a predetermined position during the inward movement of the plungers, fuel is spilled from the pumping chamber 23.

The plunger 20 defines a plunger bore 31 the inner end of which communicates by way of a pair of ports 32 with the interior of the apparatus. Slidable in the plunger bore is a piston 33 which is integrally formed and extends inwardly from the plunger 21. The pumping chamber 23 is therefore of annular form but it is bounded by the bore 22 in the distributor member.

Formed in the wall of the plunger 20 is a groove 44 and a pair of ports 34 which communicate with a circumferential groove formed in the bore 22 in the distributor member and the groove is in constant communication with a spill channel 35 formed in the distributor member. The groove 44 at inner ends of the ports are covered by the piston 33 but the latter has a reduced portion adjacent the plunger 21 the reduced portion together with the wall of the bore 31, forming an annular flow path 36 which is in communication with the pumping chamber 23. The flow path 36 is brought into communication with the ports 34 at a predetermined positioned during the inward movement of the plungers before the rollers ride over the crest of the cam lobes. Fuel can therefore flow from the pumping chamber. It is possible to make the flow path 36 sufficiently wide so that all the fuel which is spilled from the pumping chamber can flow through the ports 34 and the spill channel 35, to a drain. However, it is preferable to provide an additional valve arrangement which controls a spill passage from the pumping chamber.

Referring again to FIG. 1 the spill channel 35 communicates with the inner end of a cylinder 37 formed in the end surface of the extension 12. Located within the cylinder is a cup shaped piston 38 which is biased towards the inner end of the cylinder 37, by a coiled compression spring 39. The piston carries a projection 40 which as shown in FIG. 1, cooperates with a seating 41 which is formed about a spill passage 42 which is in direct communication with the pumping chamber 23. The spring 39 is sufficiently strong to hold the projection 40 in engagement with the seating 41 during delivery of fuel to the engine. When however, the ports 34 are uncovered to the pumping chamber, the flow of fuel into the inner end of the cylinder 37 will cause movement of the piston against the action of the spring and this movement will lift the projection 40 from its seating thereby to allow direct flow of fuel from the pumping chamber into the inner end of the cylinder 37. A rapid reduction in the pressure of fuel within the pumping chamber and the outlet is therefore obtained. Moreover, the fuel which is spilled is retained in the cylinder 37 and returned to the pumping chamber when the plungers are allowed to move outwardly by the cam lobes.

FIG. 2 shows a modification to the plungers in which the step 43 at a predetermined position during the inward movement of the plungers, uncovers the clearance 36 to an annular groove 44 formed in the internal surface of the bore 31 in the plunger 20. The groove 44 communicates with a groove 45 formed on the outer surface of the plunger 20 the two grooves being interconnected by ports 46 formed in the wall of the plunger 20. The plunger 20 has a reduced outer diameter adjacent its open end, to counter any dilation of that end as a result of increased pressure in the chamber 23. The dimensions of the plunger 20 may therefore be dictated solely by the quantity of fuel to be pumped, and without undue regard to chamber pressure.

Turning now to FIG. 3, this shows a modified form of the plungers 47, 48 in which the spillage of fuel takes place by way of the inner end of the plunger bore 49 the latter being enlarged and connected to a port 50 formed in the plunger 47. The step 52 defined between the piston 51 and the reduced portion thereof, at a predetermined position during the inward movement of the plungers moves into the enlarged inner end of the bore 49 thereby allowing fuel to spill from the pumping chamber 23 through the port 50 into the interior of the apparatus.

In the apparatus shown in FIG. 3, the outlet ports 26 are alternately arranged with the inlet ports 28 and a single groove 53 which is connected to the pumping chamber, is provided for registration with the outlet and inlet ports.

The fact that the pumping chamber 23 is of annular form means that for a given diameter of the bore in the distributor member and a given stroke of the plungers, the volume of fuel displaced by the plungers will be larger than in the example described in the aforementioned Patent specification.

The modified apparatus shown in FIG. 4 incorporates most of the features of FIG. 1, and corresponding features have identical reference numbers. The distinction from FIG. 1 is that the spill passage 42 and spring-loaded piston 38 are omitted. The spill channel 35 communicates directly with the inlet of a spring-loaded pressure relief valve 60 having a ball control element 61 which will lift at a predetermined pressure in the spill channel 35 to vent that pressure through a low pressure return line 62 to the interior of the apparatus.

We claim:

1. A fuel injection pumping apparatus for supplying fuel to an internal combustion engine, comprising a rotary distributor member housed in a body part and adapted to be driven in timed relationship with an associated engine, a pair of plungers slidable in the bore, cam means for imparting inward movement to the plungers, passage means for feeding fuel displaced by the plungers during inward movement thereof to outlet ports in turn and for supplying fuel from a source of fuel under pressure to effect outward movement of the plungers, a plunger bore defined by one of said plungers in which is slidable a piston integral with the other plunger, the inner ends of the plungers and the annular space defined about the piston and bounded by the bore in the distributor member, defining a pumping chamber from which fuel is displaced to an outlet during inward movement of the plungers, port means formed in the wall of the plunger bore, through which fuel can escape from said pumping chamber, and a reduced portion on said piston adjacent the plunger, said reduced portion defining with the wall of the plunger bore a flow path from said pumping chamber and which is opened to said port means at a predetermined relative position during the inward movement of the plungers.

2. An apparatus according to claim 1 in which said port means opens into the interior of the body part.

3. An apparatus according to claim 1 in which said port means communicates with a spill channel formed in the distributor member.

4. An apparatus according to claim 3 in which said spill channel communicates with the inner end of a cylinder formed in the distributor member, a piston slidable in the cylinder, a projection on the piston and a seating defined about a spill channel connected to said pumping chamber and a spring acting on said piston to urge the projection into engagement with the seating.

5. An apparatus according to claim 1 in which said plunger has a reduced external diameter in a zone thereof adjacent said flow path.

6. An apparatus according to claim 3 in which said spill channel communicates with a spring-loaded relief valve which is responsive to a predetermined pressure in said spill channel to spill fuel therefrom to a low pressure return line.

* * * * *